US007518627B2

(12) United States Patent
Iwamoto

(10) Patent No.: US 7,518,627 B2
(45) Date of Patent: Apr. 14, 2009

(54) IMAGE FORMING APPARATUS

(75) Inventor: Kazuyuki Iwamoto, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 184 days.

(21) Appl. No.: 10/948,165

(22) Filed: Sep. 24, 2004

(65) Prior Publication Data

US 2005/0093968 A1 May 5, 2005

(30) Foreign Application Priority Data

Sep. 24, 2003 (JP) ..... 2003-331782

(51) Int. Cl.
*B41J 2/45* (2006.01)
*B41J 2/47* (2006.01)
*B41J 2/455* (2006.01)

(52) U.S. Cl. ..... 347/238; 347/234; 347/235; 347/233

(58) Field of Classification Search ..... 347/232, 347/242, 71, 238, 233, 234, 235
See application file for complete search history.

(56) References Cited

U.S. PATENT DOCUMENTS

| | | | | |
|---|---|---|---|---|
| 5,818,506 | A * | 10/1998 | Yamaguchi et al. | 347/259 |
| 5,999,345 | A * | 12/1999 | Nakajima et al. | 359/821 |
| 6,567,201 | B1 * | 5/2003 | Tsuchida | 359/204 |
| 6,839,157 | B2 | 1/2005 | Ono et al. | 359/204 |
| 2001/0020974 | A1 * | 9/2001 | Makino | 347/235 |
| 2003/0025782 | A1 * | 2/2003 | Amada et al. | 347/233 |
| 2003/0035042 | A1 * | 2/2003 | Shimada et al. | 347/115 |
| 2004/0145644 | A1 * | 7/2004 | Makino | 347/233 |
| 2005/0093966 | A1 * | 5/2005 | Lee | 347/238 |
| 2005/0094234 | A1 * | 5/2005 | Miyatake et al. | 359/205 |

FOREIGN PATENT DOCUMENTS

| | | |
|---|---|---|
| JP | 11-109265 | 4/1999 |
| JP | 2000-280523 | 10/2000 |
| JP | 2001-174731 | 6/2001 |
| JP | 2003-185959 | 7/2003 |

* cited by examiner

*Primary Examiner*—Stephen D Meier
*Assistant Examiner*—Sarah Al-Hashimi
(74) *Attorney, Agent, or Firm*—Fitzpatrick, Cella, Harper & Scinto

(57) ABSTRACT

The image forming apparatus comprises: a first photosensitive drum; a second photosensitive drum; deflective scanning means for deflecting a laser beam and scanning by rotation; first laser irradiation means including a plurality of light emitting sources of laser beam for irradiating the first photosensitive drum, to irradiate the deflective scanning means with the laser; second laser irradiation means including a plurality of light emitting sources of laser for irradiating the second photosensitive drum, to irradiate the deflective scanning means with the laser beams; supporting means for supporting the first laser irradiation means and the second laser irradiation means; and a rotation supporting member for rotationally moving the first laser irradiation means, the second laser irradiation means and the supporting means integrally with respect to an axis generally parallel to the emanating axis of the laser beam to be emitted from the first laser irradiation means.

4 Claims, 12 Drawing Sheets

IMAGE FORMING APPARATUS

BACKGROUND OF THE INVENTION

1. Field of the Invention

The present invention relates to a scanning optical device for optically scanning and writing information, and can be properly applied to an image forming apparatus such as an electrophotographic copying machine having a photosensitive member or an electrophotographic printer having the photosensitive member.

2. Description of the Related Art

As a color image forming apparatus having image bearing members (as will be called the "photosensitive drums") independent for the individual colors of yellow, magenta, cyan and black, there is known a tandem type color image forming apparatus for obtaining color images by exposing the individual photosensitive drums to laser beams to form electrostatic latent images, by developing the electrostatic latent images with toners of the individual colors, and by superposing the obtained toner images on a sheet-shaped recording medium.

In order to lower the cost and to reduce the size of the tandem type color image forming apparatus, on the other hand, there is known a scanning optical device in which, as exposure means for exposing the individual photosensitive drums to laser beams, a rotary polygonal mirror acting as deflective scanning means is commonly used for the plural light sources, and laser beams from a plurality of light sources are deflectively scanned simultaneously by one rotary polygonal mirror to carry out exposure by irradiating a plurality of photosensitive drums.

In order to improve the recording speed, on the other hand, there is known a multi-beam scanning optical device for recording information by scanning one photosensitive drum simultaneously with a plurality of laser beams. In this multi-beam scanning optical device, however, the photosensitive drum surface is simultaneously scanned at an interval in a sub-scanning direction with a plurality of laser beams. Unless the interval between the plural laser beams is a predetermined one in the sub-scanning direction (i.e., in the rotating direction of the photosensitive drum), therefore, the scanning lines have irregular pitches in the sub-scanning direction so that the image is defective. In the case of a resolution of 600 DPI (dots per inch), the laser beam has an interval as fine as about 42 microns. This makes it necessary to adjust the interval between the laser beams in the sub-scanning direction.

Here will be described the pitch interval adjustment of the multi-beams with reference to FIG. 11 and FIG. 12. FIG. 11 is a sectional view of the laser holder portion of the related art. FIG. 12 is a schematic diagram for explaining the pitch interval adjustment of the multi-beams of the related art.

In FIG. 11, a laser holder 101 has a holding portion 101*a*, in which a semiconductor laser (or a multi-beam laser) 102 having a plurality of light emitting points packaged therein is press-fitted and held. A printed-circuit board 103 is provided with a laser drive circuit and is electrically connected with the semiconductor laser 102.

To the leading end of the holding portion 101*a*, moreover, there is adhered a collimator lens 104 for converting a luminous flux into a generally parallel one.

When this laser holder 101 is to be mounted in the not-shown casing housing the optical parts of the scanning optical device therein, the pitch interval (i.e., the interval in the sub-scanning direction) P between two light emitting points 102*a* and 102*b* of the semiconductor laser 102 is adjusted by turning the holding portion 101*a* on its center of rotation.

More specifically, when turned in the direction of arrow B shown in FIG. 12, the pitch interval P of the two light emitting points 102*a* and 102*b* of the semiconductor laser 102 is reduced. When turned in the direction of arrow C shown in FIG. 12, on the contrary, the pitch interval P of the two light emitting points 102*a* and 102*b* of the semiconductor laser 102 is enlarged.

Here, the pitch interval P of the light emitting points is likewise adjusted even in case not a semiconductor laser having a plurality of light emitting points packaged therein but a plurality of semiconductor lasers each having one light emitting point are used to synthesize with using a prism for obtaining the multi-beam.

In JP-A-2000-280523, for example, there is disclosed an optical scanning device for performing an exposure by emitting multi-beams from a plurality of light source units for irradiating a plurality of photosensitive elements with optical beams and by deflectively scanning the plural photosensitive elements in a main scanning direction (normal to the rotating direction of a photosensitive drum) by one polygon mirror. This optical scanning device is configured such that the beam spot interval between two optical beams in a sub-scanning direction is adjusted by adjusting the amount of inclination on the center of an injection axis from the main scanning direction to the sub-scanning direction using an adjusting screw.

However, the related art thus far described has the following problems.

In the related art, the light source units of the individual colors are configured separately from each other. Therefore, the inter-beam distances of the multi-beams in the sub-scanning direction have to be individually adjusted to cause a problem that many adjusting steps are required.

The present invention has been conceived in view of the problems of the aforementioned related art and has an object to provide an image forming apparatus provided with a scanning optical device which can adjust the beam interval distance in the rotating direction of an image bearing member with less working steps, even if configured to have a plurality of laser illumination means each having a plurality of light sources.

SUMMARY OF THE INVENTION

The invention has an object to adjust a beam interval distance in the rotating direction of an image bearing member with less working steps even if the configuration has a plural laser irradiation means each having a plural light sources.

According to another object of the invention, there is provided an image forming apparatus which comprises: a first image bearing member; a second image bearing member; deflective scanning means for deflecting a laser beam and scanning by rotation; first laser irradiation means including a plurality of light emitting sources of laser beam for irradiating the first image bearing member, to irradiate the deflective scanning means with the laser beams; second laser irradiation means including a plurality of light emitting sources of laser beam for irradiating the second image bearing member, to irradiate the deflective scanning means with the laser beams; supporting means for supporting the first laser irradiation means and the second laser irradiation means; and a rotation supporting member for rotationally moving the first laser irradiation means, the second laser irradiation means and the supporting means integrally with respect to an axis generally parallel to the emanating axis of the laser beam to be emitted from the first laser irradiation means.

A further object of the invention will become apparent from the description to be made in the following.

DETAILED DESCRIPTION OF THE PREFERRED EMBODIMENTS

The best mode of the invention will be illustratively described in detail with reference to the accompanying drawings. However, the sizes, materials, shapes, relative arrangements and so on of the components to be described in this embodiment are not indented to limit the scope of the invention thereto, unless otherwise specifically defined. Moreover, the materials, shapes and so on of the members once described in the following are similar to those of the initial descriptions unless otherwise specifically defined.

First Embodiment

The scanning optical device according to the embodiment and the image forming apparatus capable of using the device preferably will be described with reference to FIG. 1 to FIG. 9.

Figure 1:
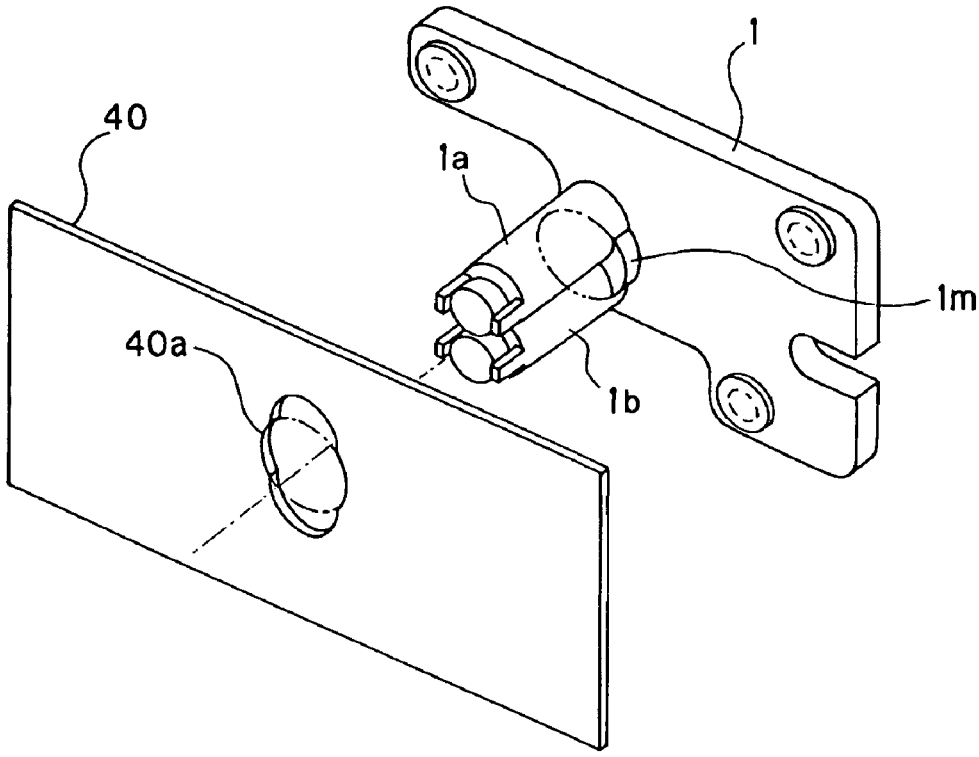
FIG. 1 is a partial, perspective view showing the behavior, in which a laser holder according to the embodiment is attached to an optical case.
Figure 2:
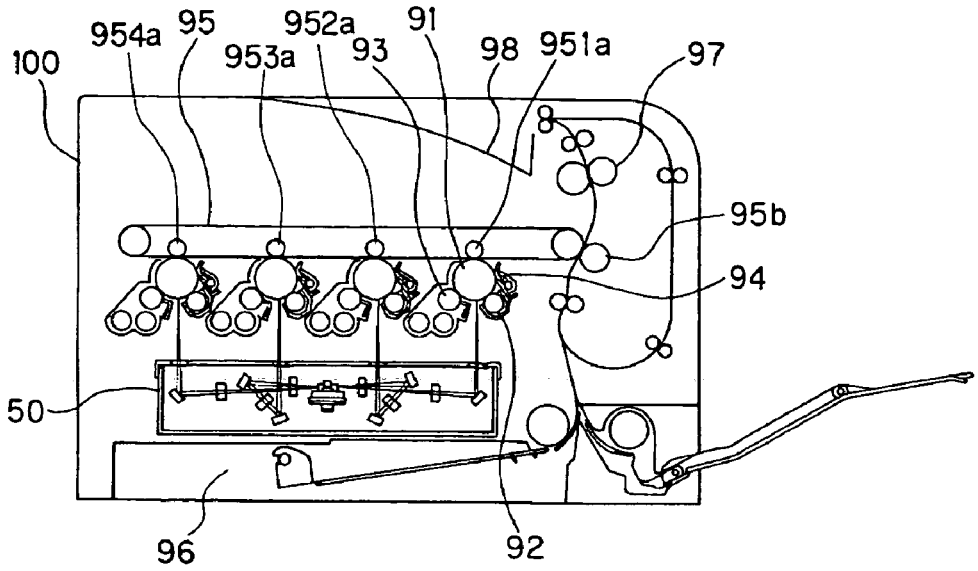
FIG. 2 is a schematic section of an image forming apparatus provided with a scanning optical device according to the embodiment.
Figure 3:
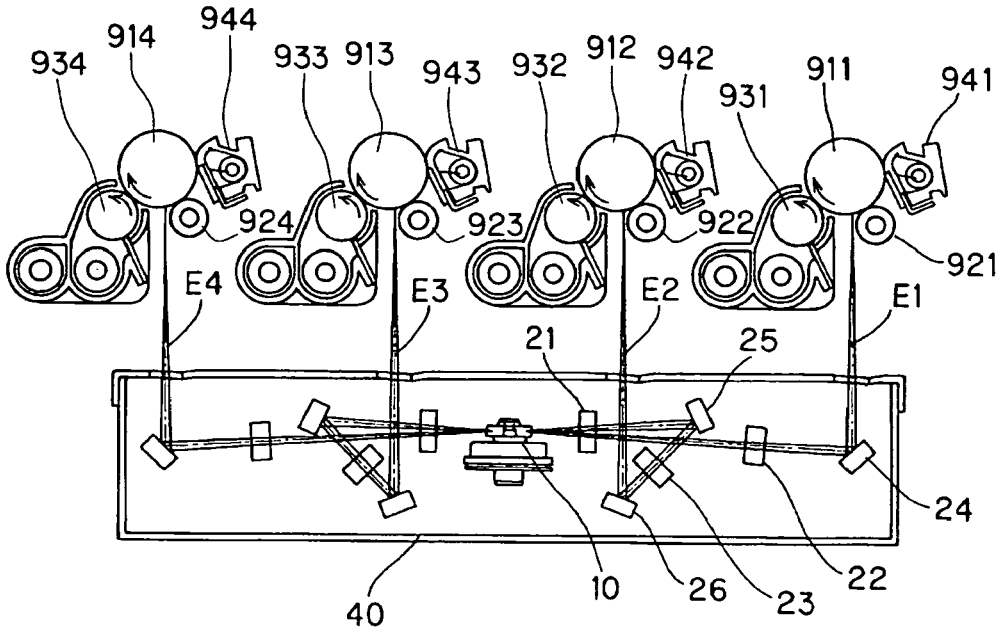
FIG. 3 is a schematic section showing a positional relation between the scanning optical device according to the embodiment and an image forming unit including photosensitive drums.
Figure 4A:
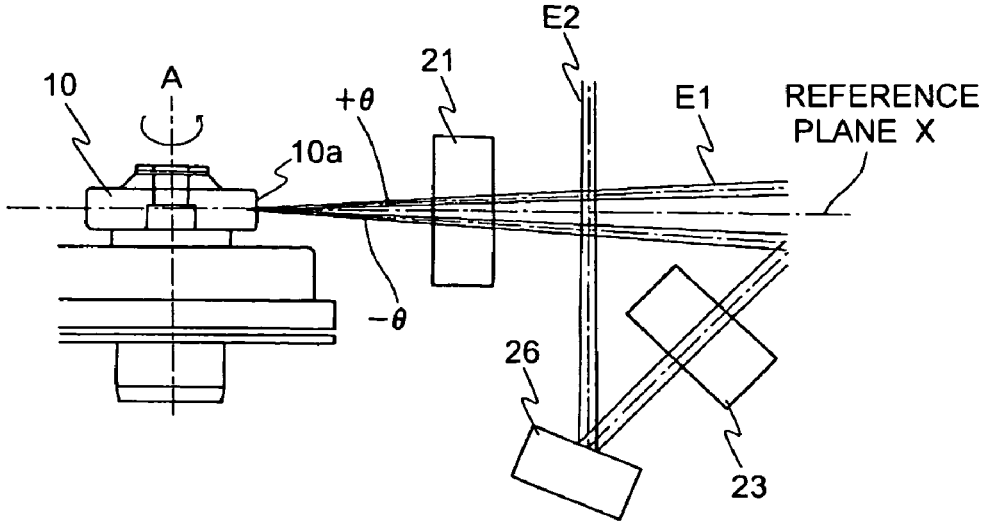
FIGS. 4A and 4B are sectional views partially showing an optical path near a polygon mirror according to the embodiment.
Figure 4B:
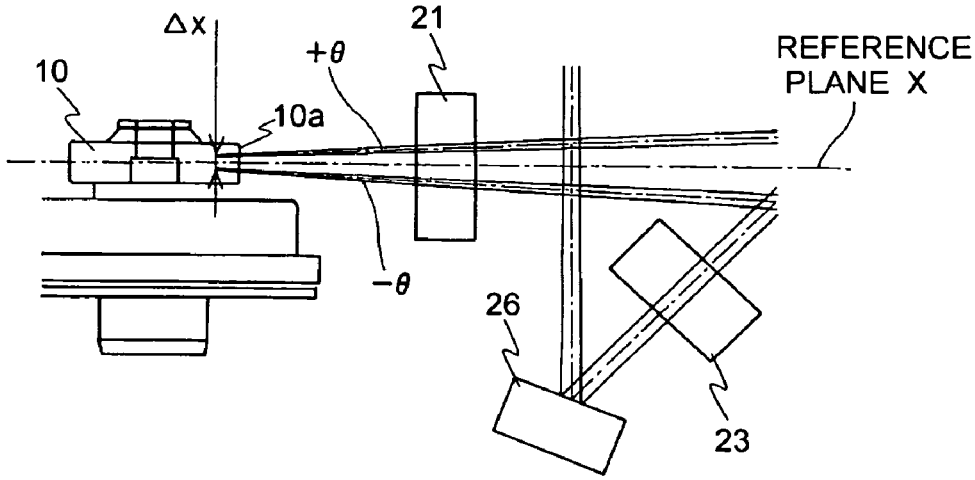
Figure 5:
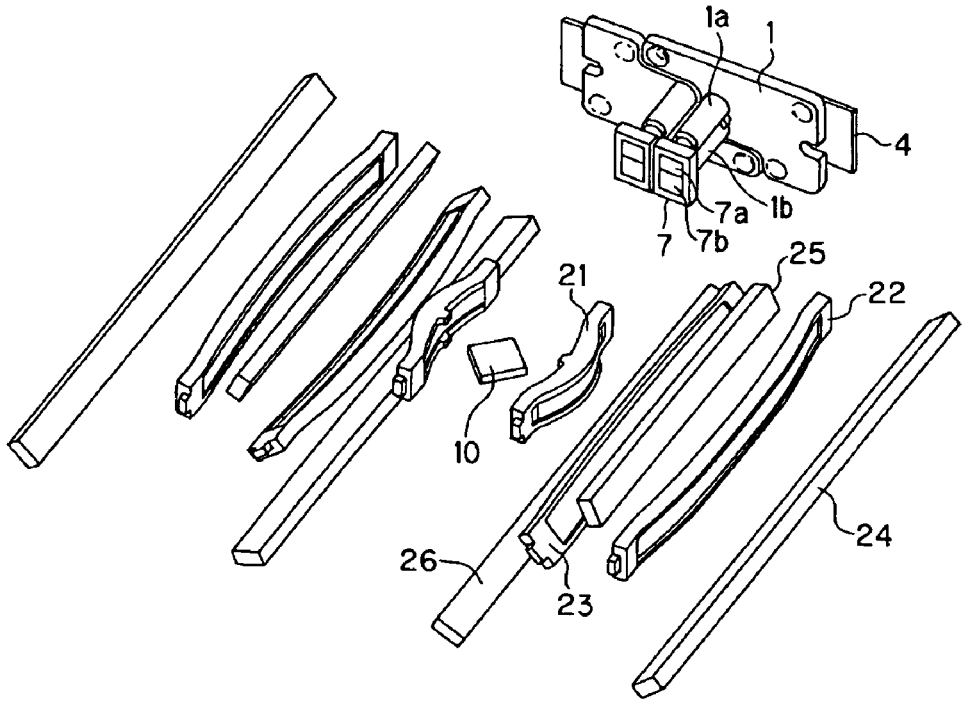
FIG. 5 is a perspective view showing the entire configuration of the scanning optical device according to the embodiment.
Figure 6:
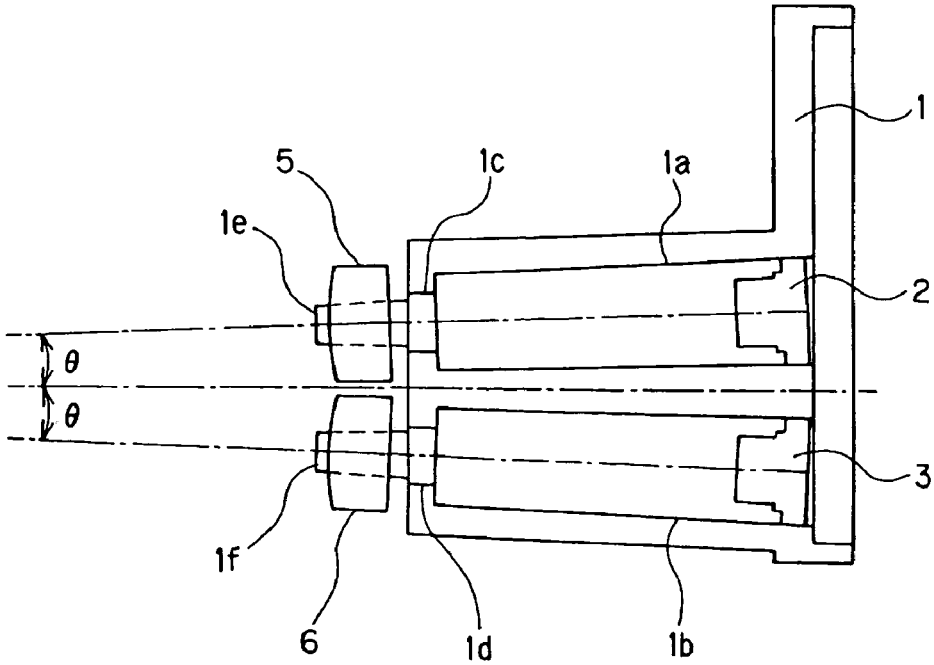
FIG. 6 is a sectional view of a laser holder unit according to the embodiment.
Figure 7A:
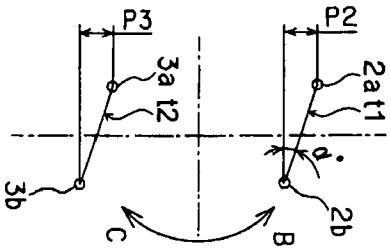
FIGS. 7A, 7B and 7C are schematic diagrams for explaining the pitch adjustments of multi-beams according to the embodiment.
Figure 7B:
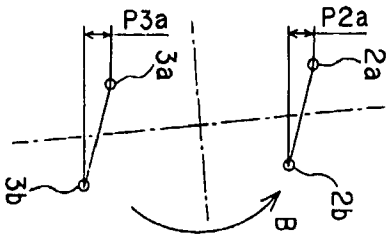
Figure 7C:
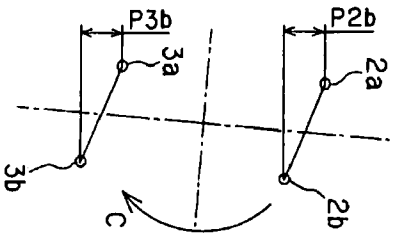
Figure 8A:
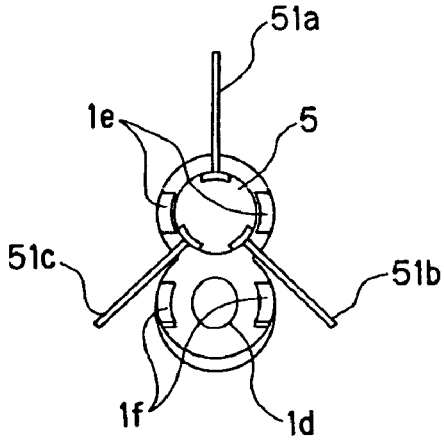
FIGS. 8A and 8B are front elevations of a portion of the laser holder for explaining the adjustments of collimator lenses according to the embodiment.
Figure 8B:
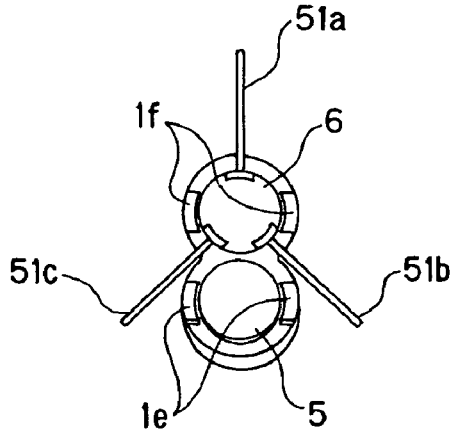
Figure 9:
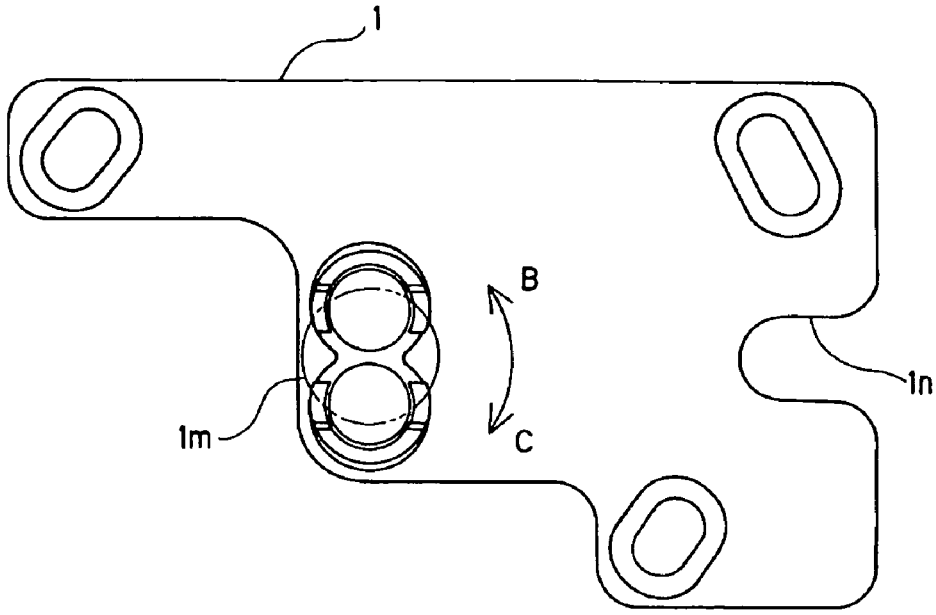
FIG. 9 is a front elevation of a laser holder according to the embodiment.

FIG. 1 is a partial, perspective view showing the behavior, in which the laser holder is attached to the optical case; FIG. 2 is a schematic section of the image forming apparatus provided with the scanning optical device according to the embodiment; FIG. 3 is a schematic section showing the positional relation between the scanning optical device and the image forming unit including the photosensitive drums; FIGS. 4A and 4B are sectional views partially showing the optical path near the polygon mirror; FIG. 5 is a perspective view showing the entire configuration of the scanning optical device according to the embodiment; FIG. 6 is a sectional view of the laser holder; FIGS. 7A, 7B and 7C are schematic diagrams for explaining the pitch adjustments of the multi-beams; FIGS. 8A and 8B are front elevations of a portion of the laser holder for explaining the adjustments of the collimator lenses; and FIG. 9 is a front elevation of the laser holder.

<Entire Configuration of Image Forming Apparatus>

First description is made on the entire configuration of the image forming apparatus. As shown in FIG. 2, an image forming apparatus 100 according to the embodiment is a tandem type printer, which is enabled to print color images by using photosensitive drums such as a plurality of image bearing members prepared by applying photosensitive layers to conductors. The image forming apparatus 100 is provided, for forming images of individual colors, with: a yellow photosensitive drum 914 for forming an yellow image as a first image bearing member; a magenta photosensitive drum 913 for forming a magenta image as a second image bearing member; a cyan photosensitive drum 912 for forming a cyan image as a third image bearing member; and a black photosensitive drum 911 for forming a black image as a fourth image bearing member.

Moreover, the image forming apparatus 100 is provided with: charging means 921, 922, 923 and 924 for charging the individual photosensitive drums to predetermined potentials; a scanning optical device 50 for generating a laser beam to expose the charged photosensitive drums thereby to form electrostatic latent images; developing means (including developing means 934 for developing with yellow toner, developing means 933 for developing with magenta toner, developing means 932 for developing with cyan toner and developing means 931 for developing with black toner) for developing the electrostatic latent images formed on the photosensitive drums, as toner images; an intermediate transfer belt 95 acting as an intermediate transfer member for superposing the developed toner images sequentially for the photosensitive drums to convey the superposed toner image as a full-color image to a recording medium; cleaning means (including cleaning means 944 for cleaning the yellow toner, cleaning means 943 for cleaning the magenta toner, cleaning means 942 for cleaning the cyan toner, and cleaning means 941 for cleaning the black toner) for cleaning and recovering the toner left undeveloped on the individual photosensitive drums; a feed cassette 96 for stocking the recording media, to which the toner image on the intermediate transfer belt 95 is transferred; fixing means 97 for fixing the toner image transferred to the recording media, thermally on the recording media; and a discharge tray 98 acting as a stacking member for stacking the recording media having the toner image fixed thereon.

<Image Forming Actions of Image Forming Apparatus>

Here will be described the image forming actions of the image forming apparatus.

The image forming apparatus 100 is irradiated with the laser beam from the scanning optical device 50, as described above, on the basis of the image information sent from an image reading device or a personal computer. The embodiment is described on the case of the full-color image. In the case of a single color, a similar process is proceeded with the photosensitive drum of the single color. The laser beam scans, as emitted, the photosensitive drum 911 charged by the charging means 921 so that it forms an electrostatic latent image on the photosensitive drum 911. Similar operations are performed on the remaining photosensitive drums.

Moreover, the toner, which is frictionally charged in the developer 931, sticks to the aforementioned electrostatic latent image thereby to from the toner image on the photosensitive drum 911. The toner image on the photosensitive drum 911 is transferred to the intermediate transfer belt 95 by primary transfer means 951*a*, and the toner image once transferred is transferred again by secondary transfer means 95*b* to the recording medium which is conveyed from the feed cassette 96 disposed in the lower portion of the apparatus body. The toner image thus transferred to the recording medium is fixed by the fixer 97 and is loaded on the discharge tray 98. Here, the primary transfer means 951*a* is a transfer member for transferring the black toner to the intermediate transfer belt 95, and the transfer members for cyan, magenta and yellow colors are designated by 952*a*, 953*a* and 954*a*, respectively.

<Scanning Optical Device>

The scanning optical device 50 according to the embodiment is arranged below the juxtaposed photosensitive drums, as shown in FIG. 2 and FIG. 3. The scanning optical device 50 adopts a multi-beam type, in which the individual photosensitive drums are scanned with individual two laser beams arranged at a predetermined spacing in the sub-scanning direction.

As shown in FIG. 3, the multi-beam type is provided with two multi-beam optical paths on the two left and right sides on the axis of rotation of a polygon mirror 10 or a rotary polygonal mirror acting as deflective scanning means so that its photosensitive drums 91 are exposed to illuminating lights E1 to E4 of the multi-beams.

Here, the scanning optical device 50 adopts such an optical system for achieving the size reduction of the apparatus that the laser beams are obliquely incident on the reflecting surface of the thin-type polygon mirror. In this optical system, luminous fluxes (or optical beams) emanating from different light emitting sources enter a reference plane X at such opposite but equal angles θ that they are reflected by the polygon mirror and are then separated individually into upper and lower optical paths. Here, the reference plane X has a normal of the axis of rotation A of the polygon mirror 10, as shown in FIG. 4A, and is normal to a reflecting surface 10*a*. By adopting such optical system, the optical characteristics can be made uniform to facilitate the design. The relative angle made between the reference plane and the advancing direction of the deflective scanning beams is preferably 3 degrees or less for the image performances.

Of the arrangements of the optical parts (e.g., the lenses or mirrors) on the optical paths in the embodiment, the polygon mirror 10 is arranged at the center, and the optical paths to the individual photosensitive drums 91 are symmetric with respect of the axis of rotation of the polygon mirror 10. Therefore, the main description will be made on the scanning optical systems of the illuminating lights E1 and E2.

As shown in FIG. 5 and FIG. 6, a laser holder 1 acting as a supporting means is provided with cylindrical holding portions 1*a* and 1*b*, in which semiconductor lasers (or multi-beam lasers) 2 and 3 having two light emitting sources packaged therein for emitting laser beams are press-fitted and held. A printed-circuit board 4 is equipped with a laser drive circuit and is electrically connected with the semiconductor lasers 2 and 3.

Here, the semiconductor lasers 2 and 3 are provided with light emitting points 2*a* and 2*b* and light emitting points 3*a* and 3*b*, respectively. The semiconductor lasers 2 and 3 are press-fitted (as referred to FIG. 7A) at such an inclination that the angles made between the straight lines t1 and t2 joining the light emitting points 2*a* and 2*b* and the light emitting points 3*a* and 3*b* and the aforementioned reference plane may be α degrees.

On the other hand, the holding portions 1*a* and 1*b* are so disposed that the plural optical axes of the laser holder 1 are incident at the angle θ on the reference axis (i.e., the axis perpendicular to the axis of rotation of the polygon mirror 10). Moreover, the holding portions 1*a* and 1*b* are integrated partially in their contours with each other. As a result, the semiconductor lasers 2 and 3 can be held close to each other. Here, the angle θ is preferably 3 degrees or less for the image performances. Thus, it is found that the reference axis and the emanating axis of the laser are generally parallel to each other.

Stop portions 1*c* and 1*d* are so disposed on the leading end sides of the holding portions 1*a* and 1*b* as to correspond to the individual semiconductor lasers 2 and 3 to thereby shape the luminous fluxes emanated from the semiconductor lasers 2 and 3 into the desired optimum beam shapes.

Collimator lenses 5 and 6 collimate the individual luminous fluxes having passed the stop portions 1*c* and 1*d*, into generally parallel luminous fluxes. The collimator lenses 5 and 6 are fixed on the leading end sides farther than the stop portions 1*c* and 1*d*, by adhering portions 1*e* and 1*f* disposed individually at two portions in the main scanning direction.

As shown in FIG. 8A, the collimator lenses 5 and 6 are so adjusted in the radiating positions and the focal points that the collimator lens 5 is reliably held at three positions of adjusting chucking portions 51*a*, 51*b* and 51*c*. The collimator lens 5 is adjusted in the three axis directions X, Y and Z while detecting the optical characteristics of the laser beam, and is adhered and fixed, when its position is determined, on the adhering portion 1*e* by irradiating an ultraviolet-curing adhesive with an ultraviolet ray.

Next, the adjustment of the collimator lens 6 is also made by turning the laser holder 1 by 180 degrees, as shown in FIG. 8B. The collimator lens 6 is adhered and fixed, when its position is determined, on the adhering portion 1*f*.

Since the adhering portions 1*e* and 1*f* of the collimator lenses 5 and 6 are thus disposed in the main scanning direction, the three adjusting chucking portions 51*a*, 51*b* and 51*c* can hold the collimator lenses reliably at the three portions without interfering with the adhering portions 1*e* and 1*f* and the collimator lenses adhered and fixed beforehand. Thus, the adjustments and adhesions in the three axial directions can be made on the laser holder 1 having the lens mount, in which the collimator lenses 5 and 6 are integrated close to each other.

Since the collimator lenses 5 and 6 are held, after adjusted, by adhering and fixing them in the three axial directions, moreover, the optical paths can be shortened in the optical system to the polygon mirror 10 while satisfying the optical characteristics of the semiconductor lasers 2 and 3. As a result, the parts number of the laser holder 1 can be reduced to make the scanning optical device compact with the simple configuration.

Since the adjustments and adhesions of the collimator lenses 5 and 6 are individually performed by turning the laser holder 1 by 180 degrees, still moreover, the common adjusting and adhering device can be used even in the inclination of θ degrees with respect to the sub-scanning direction so that any unnecessary investment for the facilities can be avoided.

Thus in the embodiment, the first laser irradiation means is means including the laser illumination source 2 and the collimator lens 5 for irradiating the polygon mirror 10 with the laser. Likewise, the second laser irradiation means is means including the laser illumination source 3 and the collimator lens 6 for irradiating the polygon mirror 10 with the laser.

An optical case 40 houses the individual optical parts of the scanning optical device 50. In the side wall of the optical case 40, moreover, there is formed a fitting hole portion 40*a* for positioning the laser holder 1, as shown in FIG. 1. A fitted portion 1*m* as rotary supporting portion disposed at the center portions of the holding portions 1*a* and 1*b* of the laser holder 1 is fitted in the fitting hole portion 40*a*.

Therefore, the optical case 40 rotatably supports the laser holder 1 having the fitted portion 1*m,* so that the optical case 40 functions as a rotation supporting member.

Thus, the fitted portion 1*m,* which is formed at the center portions of the holding portions 1*a* and 1*b* for holding the semiconductor lasers 2 and 3 to form the optical path, is fitted in the fitting hole portion 40*a* formed in the side wall of the optical case 40. By pushing an adjusting groove in with an eccentric cam or the like to turn the laser holder 1 on the fitted portion 1*m*, therefore, the pitch interval (the interval in the sub-scanning direction) P between the two light emitting points 2*a* and 2*b,* and 3*a* and 3*b* individually owned by the semiconductor lasers 2 and 3 can be varied by the simple configuration.

More specifically, the semiconductor lasers 2 and 3 are press-fitted at an inclination of the angle α degrees, as made between the individual straight lines joining the light emitting points 2*a* and 2*b* and the light emitting points 3*a* and 3*b* and the aforementioned reference plane. When the laser holder 1 is turned in the direction of arrow B, as shown in FIG. 7B, the pitch interval P2 between the light emitting points 2*a* and 2*b* of the semiconductor laser 2 becomes P2*a,* and the pitch interval P3 between the light emitting points 3*a* and 3*b* of the semiconductor laser 3 becomes P3*a,* so that both the pitch intervals of the light emitting points become smaller. When the laser holder 1 is turned in the direction of arrow C, as shown in FIG. 7C, the pitch interval P2 between the light emitting points 2*a* and 2*b* of the semiconductor laser 2 becomes P2*b,* and the pitch interval P3 between the light emitting points 3*a* and 3*b* of the semiconductor laser 3 becomes P3*b*, so that both the pitch intervals of the light emitting points become larger.

In the embodiment, the pitch interval distances of the individual semiconductor lasers are adjusted by turning the laser holder 1 on the reference axis generally in parallel with the laser.

At the time of adjusting the aforementioned pitch interval, a CCD camera or the like is placed at a position corresponding to the drum face to be scanned, and the spot interval of the two light emitting points 2*a* and 2*b* of the semiconductor laser 2 and the spot interval of the two light emitting points 3*a* and 3*b* of the semiconductor laser 3 are simultaneously measured. As a result, the pitch intervals P between the two light emitting points 2*a* and 2*b,* and 3*a* and 3*b* owned by the semiconductor lasers 2 and 3 can be simultaneously adjusted.

Moreover, the laser holder 1 is mounted in the optical case 40 by fitting the fitted portion 1*m,* which is formed at the center portions of the holding portions 1*a* and 1*b* for holding the semiconductor lasers 2 and 3 to form the optical path, in the fitting hole 40*a* formed in the sub-scanning direction of the side wall of the optical case 40. Therefore, the positional relations between the semiconductor lasers 2 and 3 and the individual optical parts housed in the optical case 40 can be precisely warranted. Even in case the optical case 40 or the laser holder 1 is thermally expanded by the environmental fluctuations such as the temperature change, moreover, the displacements of the positioning portions and the light emitting source from the optical case 40 are equal between the semiconductor lasers 2 and 3 so that the color drifts, as might otherwise be caused by the environmental fluctuations or the like, can be prevented by the simple configuration. If the laser holder 1 and the optical case 40 are fixed with the fixing members such as screws by making use of the groove in of FIG. 9, moreover, it is preferable because the positioning can be retained.

A cylindrical lens 7 has a predetermined refractivity only in the sub-scanning direction and is molded integrally with lens portions 7*a* and 7*b* for corresponding to the luminous fluxes emitted from the semiconductor lasers 2 and 3.

The rotary polygon mirror 10 is rotated at a predetermined speed by the not-shown motor, and deflects and scans the luminous flux, which is emanated from the semiconductor laser and passes through the cylindrical lens.

In the embodiment, as shown in FIG. 5, the third laser irradiation means and the fourth laser irradiation means, which are arranged symmetrically with the first laser irradiation means and the second laser irradiation means, are arranged in the same configuration as that of the first laser irradiation means.

A first focusing lens 21 is an fθ lens for focusing the deflected and scanned luminous flux together with second focusing lenses 22 and 23 into a spot on the photosensitive drum so that it scans the photosensitive drum at an equal speed with that luminous flux. The first focusing lens 21 is made of a cylindrical lens because the luminous fluxes emitted from the semiconductor lasers 2 and 3 are incident at different angles. Moreover, the luminous flux is focused in the sub-scanning direction by the second focusing lens 22 arranged for the luminous flux of the semiconductor laser 2 and by the second focusing lens 23 arranged for the luminous flux of the semiconductor laser 3.

Mirrors 24, 25 and 26 reflect the luminous flux in predetermined directions. The mirror 24 is a final return mirror arranged for the luminous flux of the semiconductor laser 2; the mirror 25 is a separating return mirror arranged for the luminous flux of the semiconductor laser 3; and the mirror 26 is a final return mirror arranged for the luminous flux of the semiconductor laser 3. Here, the reflected positions of the two luminous fluxes on the polygon mirrors may be identical or deviated in the height direction of the mirror face, as shown in FIGS. 4A and 4B. By deviating the reflection position on the polygon mirror 10 by Δx, as shown in FIG. 4B, the position of the mirror 25 can be arranged closer to the polygon mirror 10.

Here will be described in more detail the flows of the luminous fluxes emitted from the semiconductor lasers 2 and 3, till the luminous fluxes are scanned through the aforementioned optical parts as the illuminating lights E1 and E2 of the multi-beams by the photosensitive drums. In the embodiment, the luminous fluxes emitted from the third laser irradiation means and the fourth laser irradiation means are likewise treated, as will be described in the following. This is also apparent in view of FIG. 3.

The luminous fluxes emitted from the semiconductor lasers 2 and 3 are restricted, in their sizes taken in the luminous flux section, by the stop portions 1*c* and 1*d* of the laser holder 1 and are converted into generally parallel luminous fluxes by the collimator lenses 5 and 6, so that they enter the lens portions 7*a* and 7*b* of the cylindrical lens 7.

The luminous fluxes having entered the cylindrical lens 7 transmit while keeping their shapes in the main scanning direction but are converged in their shapes in the sub-scanning direction, so that they are focused as generally linear images on the same face of the polygon mirror 10. At this time, the luminous fluxes are obliquely incident at the angle θ with respect to the reference plane. As the polygon mirror 10 rotates, moreover, the luminous fluxes emanate at the angle θ from the reference plane while being deflected to scan.

The luminous fluxes emitted from the polygon mirror 10 are individually received by the not-shown BD sensors. These BD sensors detect all the luminous fluxes of the multi-beams emanating from the semiconductor lasers 2 and 3, and output a synchronizing signal to adjust the timings of the scan starting positions of the image end portions of the individual light emitting points 2*a* and 2*b,* and 3*a* and 3*b* of the multi-beams by the semiconductor lasers 2 and 3. The timed luminous fluxes emitted from the semiconductor lasers 2 and 3 pass through the first focusing lens 21.

After this, the luminous flux having emanated from the semiconductor laser 2 passes through the second focusing lens 22 and is reflected by the mirror 24 so that it is focused to scan the photosensitive drum 91 as the illuminating light E1 of the multi-beams. On the other hand, the luminous flux having emanated from the semiconductor laser 3 is reflected downward by the mirror 25. After this, the reflected luminous flux passes through the second focusing lens 23 and is reflected by the mirror 26 so that it is focused to scan the photosensitive drum 91 as the illuminating light E2 of the multi-beams.

Here, the illuminating lights E1 and E2 of the multi-beams are adjusted at the pitch intervals between the individual light emitting points 2*a* and 2*b*, and 3*a* and 3*b* of the multi-beams by the semiconductor lasers 2 and 3, so that they can scan the photosensitive drum 91 with the individual two laser beams at a predetermined interval in the sub-scanning direction.

Thus, according to the embodiment, the arrangement interval of the plural light emitting sources for irradiating the different photosensitive elements can be shortened so that the parts number of the scanning optical device can be reduced with the simple configuration thereby to make a compact configuration. At the same time, the pitch interval adjustments in the sub-scanning direction of the plural light emitting points owned by the semiconductor laser of the multi-beam type can be simultaneously performed to shorten the assembly adjusting time period thereby to enhance the working efficiency.

The plural light emitting sources (i.e., the semiconductor lasers 2 and 3) individually have the plural light emitting points (2*a* and 2*b*, and 3*a* and 3*b*) and are so held that the straight lines t1 and t2 joining the plural light emitting points (2*a* and 2*b*, and 3*a* and 3*b*) are parallel to each other and make the predetermined angle $\alpha$ with respect to the reference plane X. With the simple configuration, the pitch intervals in the sub-scanning direction of the plural light emitting points owned by the semiconductor laser of the multi-beam type can be adjusted at a small turning angle and simultaneously. Therefore, the time period for assembly and adjustment can be shortened to enhance the working efficiency.

By pushing the adjusting groove 1*n* formed in the aforementioned holder 1, this holder 1 can be turned on the aforementioned fitted portion 1*m* so that the holder can be turned on the fitted portion with the simple configuration thereby to contribute to the reduction in the cost for the apparatus.

Here, the scanning optical device according to the embodiment has been described on the type, in which two optical paths are provided individually on the two sides of one polygon mirror 10 and in which the individual photosensitive drums 91 are exposed with the illuminating lights E1 to E4 of the multi-beams. Nevertheless, the invention should not be limited even if the type is modified such that four optical paths of the multi-beams are disposed on one side of the polygon mirror 10 thereby to expose the four photosensitive drums.

Moreover, the configuration of the laser holder 1 is integral in the embodiment. Nevertheless, even the configuration, in which the plural parts are combined to assemble the laser holder, will not raise any problem as long as the laser holder supports the first laser irradiation means and the second laser irradiation means when these means are finally assembled.

Figure 10:
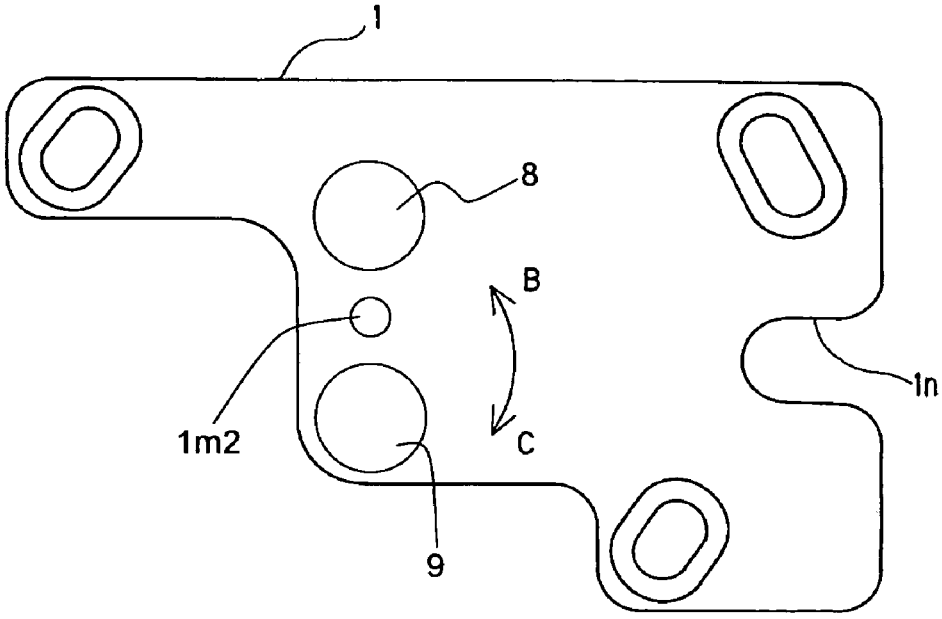
FIG. 10 is a front elevation of a laser holder according to another embodiment.
Figure 11:
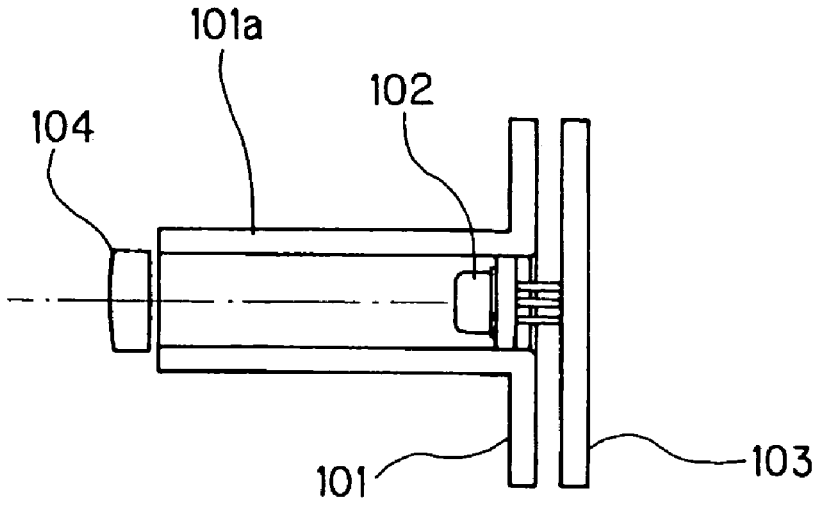
FIG. 11 is a sectional view showing a laser holder unit.
Figure 12:
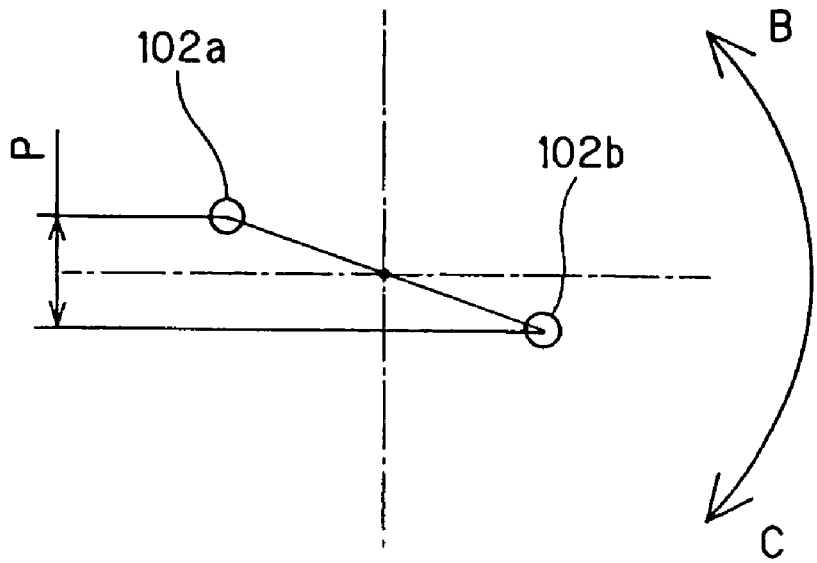
FIG. 12 is a schematic diagram for explaining a pitch interval adjustment of the multi-beams.

In the embodiment, moreover, the method for rotating the laser holder 1 uses the fitted portion 1*m*. Nevertheless, no problem arises even if there is provided a rotation supporting member, as shown in FIG. 10. In this rotation supporting member, a rotation supporting member 1*m*2 is mounted on the laser holder between the first laser irradiation means 8 and the second laser irradiation means 9. It is preferred for the adjustment that the rotation supporting member 1*m*2 is centered at the intermediate position between the first laser irradiation means and the second laser irradiation means. This rotation supporting member 1*m*2 can be made rotatable by fitting it in the corresponding portion of the optical case 40, as in the foregoing embodiment. The effects of the invention can also be attained even with that configuration.

According to the invention, as has been described hereinbefore, even if the configuration includes a plurality of laser irradiation means having a plurality of light emitting sources, the inter-beam distance in the rotational direction of the image bearing members can be adjusted with less working steps.

Although the invention has been described in connection with its embodiments, it should not be limited anyhow by the embodiments but can be modified in any manner within the technical concept thereof.

This application claims priority from Japanese Patent No. 2003-331782 filed Sep. 24, 2003, which is hereby incorporated by reference herein.

What is claimed is:

1. An image forming apparatus comprising:

a first image bearing member;

a second image bearing member;

a first irradiation device configured to irradiate said first image bearing member with a first group of laser beams so as to form a latent image on said first image bearing member;

a second irradiation device configured to irradiate said second bearing member with a second group of laser beams so as to form a latent image on said second image bearing member;

a rotating polygonal mirror configured to scan the first group of laser beams from said first irradiation device on said first image bearing member, and configured to scan the second group of laser beams from said second irradiation device on said second image bearing member, respectively, in a main-scan direction; and a supporting member configured to support said first irradiation device above a reference plane which is normal to a rotational axis of said rotating polygonal mirror, and configured to support said second irradiation device below the reference plane, wherein said supporting member is mounted for rotational movement around a common center between said first irradiation device and said second irradiation device, wherein said supporting member supports said first irradiation device and said second irradiation device so that said first group of laser beams and said second group of laser beams are irradiated at an angle relative to the reference plane, and wherein a pitch interval in a sub-scanning direction of the first group of laser beams on said first image bearing member and a pitch interval in a sub-scanning direction of the second group of laser beams on said second image bearing member are both changed at the same time by a single rotation of said supporting member around the common center.

2. An image forming apparatus according to claim 1, wherein a variation of the pitch interval of the first group of laser beams on said first image bearing member is the same as that of the second group of laser beams on said second image bearing member.

3. An image forming apparatus according to claim 1, wherein said supporting member is rotationally movable with respect to an axis substantially parallel to the first and second groups of laser beams.

4. An image forming apparatus according to claim 1, wherein said first irradiation device and said second irradiation device include optical axes which are mutually slanted relative to each other.

* * * * *